United States Patent [19]

Carder

[11] 4,069,542

[45] Jan. 24, 1978

[54] CARPET SECURING STRIPS

[76] Inventor: William E. Carder, 838 Smith St., Rochester, N.Y. 14606

[21] Appl. No.: 746,258

[22] Filed: Dec. 1, 1976

[51] Int. Cl.[2] ..... A47G 27/04

[52] U.S. Cl. ..... 16/16; 24/73 R; 85/11

[58] Field of Search ..... 16/16, 6, 5, 8, 4; 24/152, 73 VA, 73 R, 87 R; 85/11, 17

[56] References Cited

U.S. PATENT DOCUMENTS

| | | | |
|---|---|---|---|
| 2,051,191 | 8/1936 | Watson | 24/73 FT UX |
| 2,554,674 | 5/1951 | Karas | 16/16 |
| 2,587,836 | 3/1952 | Goodmoot | 16/16 |
| 2,611,918 | 9/1952 | Jaasund | 16/5 |
| 2,677,145 | 5/1954 | Adams | 16/16 |
| 2,733,475 | 2/1956 | McMeans | 16/16 |
| 3,008,173 | 11/1961 | Goss et al. | 16/16 |
| 3,413,678 | 12/1968 | Krantz | 16/16 |
| 3,670,360 | 6/1972 | Hill | 16/16 |

FOREIGN PATENT DOCUMENTS

| | | | |
|---|---|---|---|
| 846,739 | 8/1960 | United Kingdom | 16/8 |

*Primary Examiner*—Andrew V. Kundrat

[57] ABSTRACT

The strips are designed to be manufactured from relatively thin or light gauge metal or plastic; each having an elongate base section designed to be secured by nails and/or adhesive to a floor, and having an offset carpet-gripping section which in one embodiment is designed in use to be hammered or bent downwardly relative to the base section and over the edge of a section of carpeting to secure the latter in place, and which in a second embodiment has formed in its longitudinal edge a plurality of spaced teeth which imbed in the bottom of a carpet to hold its edge in place. In the second embodiment a plurality of longitudinally spaced scallops or dimples are formed in the strip to increase its structural rigidity; and in each embodiment adhesive strips are used to help secure the carpeting to the strips.

3 Claims, 6 Drawing Figures

CARPET SECURING STRIPS

This invention relates to carpeting, and more particularly to an improved strip material for securing the edges of wall-to-wall carpeting, and the like, to the floor or other surface on which the carpeting is installed.

There are currently on the market several forms of so-called tackless carpet strips, which are employed, instead of tacks, to secure the edges of carpets of rugs to a wooden floor or the like. Several such strips are disclosed in U.S. Pat. Nos. 2,554,674; 2,611,918; 3,008,173; 2,677,145; 2,733,475; 2,587,836; and 2,051,191.

These known carpet securing strips are manufactured in various shapes and lengths, and have in common some form of gripping means, other than tacks per se, for gripping and holding carpet edges in place. For example, a strip of the type illustrated in the above-noted U.S. Pat. No. 2,554,674 is adapted to be nailed or otherwise secured to a floor so that a longitudinally extending edge of the strip is spaced slightly from an adjacent vertical wall. This permits the edge of a carpet to be folded or tucked over and beneath the edge of the strip which confronts the wall, so that a plurality of spaced, upright tangs, which are struck upwardly from the strip, will imbed in the underside of the carpet to prevent its folded edge from being withdrawn from between the strip and the wall.

Among the primary disadvantages of carpet fastening strips of the type described is that they heretofore have been rather expensive to manufacture, and have not always performed satisfactorily in holding carpet edges securely in place. In the case of carpet installations of the wall-to-wall variety, for example, carpeting usually must be stretched mechanically during installation to prevent undesirable ripples or puckering in the installed carpet. For this reason it has been customary to make most such carpet strips out of relatively rigid steel or sheet metal, so that when the carpet is subjected to the stretching operation the strip will not tend to bend or otherwise fail. Moreover, particularly in the case where tangs are struck up from the strip to be imbedded into the backing of the carpet, the material from which these tangs are made must be very strong to prevent such tangs or teeth from being sheared, or otherwise bent out of place during the carpet-stretching operation, or for that matter during normal usage after the carpeting has been installed.

It is an object of this invention, therefore, to provide improved carpet securing strips of the type described which are substantially more inexpensive and reliable than prior such strips.

Still another object of this invention is to provide improved carpet stripping, which although made from lighter or finer gauge material than prior such stripping, nevertheless exhibits the necessary structural rigidity to enable the stripping to be used for securing in place the edges of wall-to-wall carpeting, and the like.

Still another object of this invention is to provide improved carpet fastening strips which function more positively to secure carpet edging to a floor, or the like, than was possible with prior such fastening strips.

Another object of this invention is to provide novel carpet stripping which employs adhesive material for assisting in securing the edges of wall-to-wall carpeting in place during and after installation of the carpeting.

Other objects of this invention will be apparent hereinafter from the specification and from the recital of the appended claims, particularly when read in conjunction with the accompanying drawing.

Figure 1:
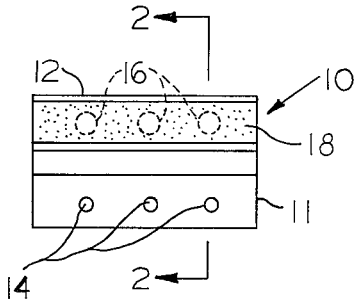
FIG. 1 is a plan view of a novel carpet fastening strip made according to one embodiment of this invention.
Figure 2:
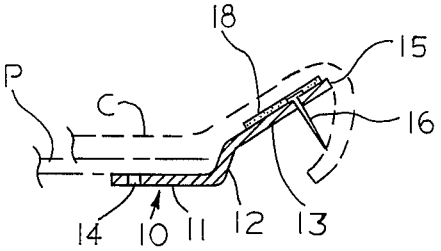
FIG. 2 is a sectional view taken along the line 2—2 in FIG. 1 looking in the direction of the arrows, and illustrating fragmentarily, and in phantom by broken lines, the manner in which the edges of a section of carpeting and its underlying pad are adapted to be positioned on the strip.

Referring now to the drawing by numerals of reference, and first to the embodiment shown in FIGS. 1 and 2, 10 denotes generally a carpet securing strip comprising a plane base or floor-engaging section 11, a relatively short, diagonal, rib section 12, and an inclined, upright, carpet-gripping section 13. Section 11 has therethrough a plurality of spaced openings 14 for accommodating the tacks or nails (not illustrated) which are adapted to be used for nailing of this base section in an operative position on a wooden floor, or the like, wherein the longitudinally extending edge 15 of the carpet-gripping section 13 will be disposed in spaced, confronting relation to a vertical wall, for example, or to the vertical edge of a horizontally disposed door step or sill plate.

The carpet-engaging or gripping section 13 also has therein a plurality of spaced openings through which extend the shanks of a plurality of conventional carpet tacks 16, the heads of which overlie the upper surface of section 13 beneath a thin, longitudinally extending layer 18 of adhesive material. The underside of the layer 18 of adhesive material is securely fixed to the face of the strip section 13; and the upper or outer face of the layer 18 has a pressure-sensitive, tacky surface which may be covered in a conventional manner by a removable, plastic cover strip, or the like (not illustrated).

In use, after the strip 10 has been secured in place, as noted above by nails (not illustrated) which extend through the openings 14, the pad P for carpeting C is placed on the floor so that one edge thereof overlies the base section 11 of the strip with the edge of the pad confronting the rib section 12. The protective plastic strip, which covers the adhesive surface of the layer 18, is then removed, and the edge of the carpeting C, which is to be secured by the strip 10, is folded over the edge 15 of section 13 and downwardly beneath the pointed ends of the tacks 16. A hammer or other blunt instrument is then employed to strike the edge of the carpet within the area thereof overlying the adhesive layer 18 and the heads of the tacks 16, so that the carpet-gripping section 13 of the strip is bent downwardly relative to section 11, and sufficiently to cause the pointed ends of the tacks 16 to pass through the registering edge of the carpet C and into the associated floor to which the carpet is to be secured.

A primary advantage of a fastening strip of this type is that it is suitable for use adjacent either a vertical wall or a horizontally disposed sill plate of the type which extends across the bottom of a doorway, or the like. Particularly in the case of doorways, it is common practice currently to employ very rigid and expensive molding strips which are specially designed solely for securing the edge of a carpet along one side or the other of a doorway or sill. In the case of doorways where the sill plate is nearly flush with the adjacent floor, conventional strips of the type disclosed for example in the above-noted U.S. Pat. No. 2,554,674 are not satisfactory for use in doorways of this type because the carpet-gripping sections thereof extend too far above the floor level. But with applicant's novel strip 10, the gripping section 13 of the strip can be bend downwardly and held by the tacks 16 securely in an operative position in which the section is nearly coplanar with an adjacent door sill, or the like. Furthermore, by employing the tacks 16, in combination with the adhesive layer 18, it is possible for carpeting to be installed substantially faster and with more accuracy than was heretofore possible. With prior strips of the type noted in the above patents, for example, it was not possible to secure nails directly through the marginal edge of the carpet stripping as is now made possible by the carpet nails 16 which form part of applicant's novel strip 10.

Figure 3:
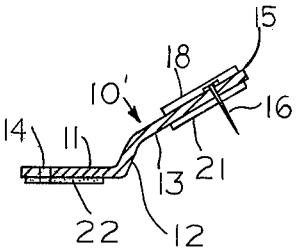
FIG. 3 is a sectional view similar to FIG. 2 but illustrating a modification of this strip.

Referring now to FIG. 3, 10' denotes generally a modification of the strip shown in FIGS. 1 and 2. In this embodiment, wherein like numerals are employed to denote elements similar to those illustrated in the first embodiments, two additional layers 21 and 22 of adhesive are secured to the undersides of the sections 13 and 11, respectively, so that any carpeting folded over the carpet-engaging section 13 will be engaged with adhesive material both at the top and bottom surfaces of section 13. In this embodiment, therefore, it would be possible, if desired, to eliminate the tacks 16 and rely solely upon the adhesive surfaces 18 and 21 for securing the rolled edge of the carpet beneath the section 13. Likewise, the adhesive section 22, which is secured to the underside of section 11, could be utilized, either alone, or in conjunction with nails which extend through the openings 14 in section 11, for securing the strip 10' in a desired location on a floor.

Figure 4:
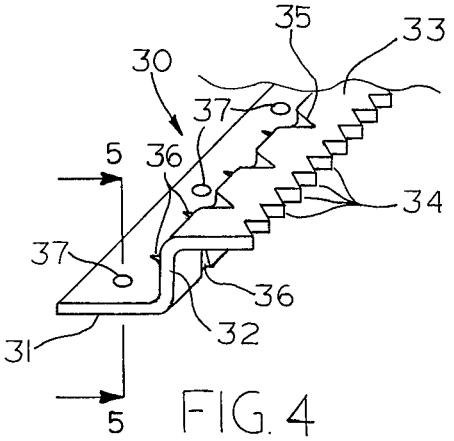
FIG. 4 is a fragmentary perspective view of a carpet fastening strip made according to still another embodiment of this invention.
Figure 5:
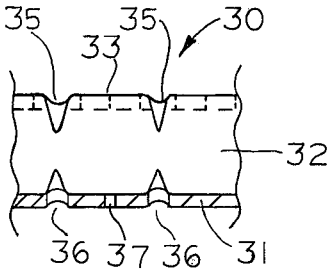
FIG. 5 is a fragmentary sectional view taken generally along the line 5—5 in FIG. 4 looking in the direction of the arrows.

Referring now to FIGS. 4 and 5, 30 denotes still another form of carpet fastening strip comprising a plane base section 31, an upright rib section 32, which extends upwardly at right angles to section 31, and a plane carpet-engaging section 33, which projects laterally from the upper end of the rib section 32 parallel to the base section 31. The longitudinally extending edge of the carpet-engaging section 33 is serrated so as to have formed therealong a plurality of spaced teeth 34, which are engageable with the underside of a carpet edge, when the latter is folded thereover in a manner similar to that in which the carpet C (FIG. 2) is folded over the edge 15 of the strip 10. To increase the strength of the strip 30, and to prevent any undesirable bending of the carpet-engaging section 33 relative to the supporting rib section 32, a plurality of longitudinally spaced scallops or indentations 35 are formed transversely of the strip 30 at the juncture of sections 32 and 33. Similar, longitudinally spaced scallops 36 are formed in strip 30 at the junction of its base section 31 and rib section 32.

In use, the base section 31 of the strip 30 is secured to a floor, or the like, by a plurality of nails or tacks (not illustrated), which are inserted through spaced openings 37 in the section 31. When strip 30 has been secured in an operative position, the edge of a carpet can be folded over the edge of section 33 so that the teeth 34 imbed in the underside of the carpet (see for example FIG. 6) to secure the edge snuggly between the serrated edge of the strip and an adjacent wall or step.

Unlike strip 10, the carpet engaging section 33 of strip 30 is not designed to be bent relative to its base section 31 during installation. Strip 30, therefore, is particularly suitable for use in securing carpeting in place at the juncture of a floor and wall, although it could be used also across doorways where the sill plates are high enough to register approximately with the strip section 33.

Figure 6:
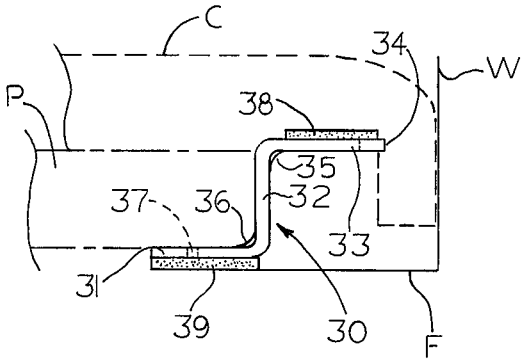
FIG. 6 is an end view of a modified form of the strip shown in FIGS. 4 and 5, and showing this strip secured to a floor adjacent an upright wall section, and with the edges of the associated carpet and pad therefor shown in phantom by broken lines.

In FIG. 6 the numeral 30' denotes generally a modification of the strip shown in FIGS. 4 and 5. In this embodiment, wherein like numerals are employed to denote elements similar to those illustrated in FIGS. 4 and 5, longitudinally extending layers 38 and 39 of adhesive are secured, respectively, to the upper surface of the carpet-engaging section 33, and to the underside of the base section 31 of strip 30'. As in the case of the embodiment shown in FIG. 3, the outer surfaces of the adhesive layers 38 and 39 may have plastic cover strips removably secured thereover to protect the pressure-sensitive surfaces of the layers 38 and 39 until the strip is placed in use. The modified strip 30' also includes the nail holes 37 in the base section 31 so that it is possible to secure this strip to a floor F at its intersection with a wall W both through the use of nails or tacks, as well as by using the tacky surface of the adhesive layer 39, after its protective cover (not illustrated) has been removed. Likewise, with this type of strip, the adhesive layer 38 assists the teeth 34 in securing the edge of the associated carpet C in place.

From the foregoing is will be apparent that the instant invention provides relatively simple and inexpensive means for securing carpet edges in place during the installation of wall-to-wall carpeting and the like. Moreover, by employing bendable strips of the type disclosed in FIGS. 1 to 3, it is possible to utilize carpet tacks, or the like, for positively securing the edge of carpeting to a floor, rather than relying solely upon serrated surfaces or edges, as was previously the practice. Furthermore, such strips can also utilize adhesive means for securing the strip in place on a floor, as well as adhesive means for engaging and securing the marginal edge of the carpet itself in place.

In the embodiment shown in FIGS. 1 and 3, the strip may be made from, for example, aluminum, steel or a synthetic material which will enable the carpet-engaging section 13 to be pounded or otherwise hammered down relative to the base section 11 after the latter has been secured in place on a floor. As the section 13 is bent downwardly, of course, the carpet tacks 16 are forced through the carpeting and into the floor positively to secure the carpeting in place. Not only do the tacks secure the carpet to the floor, but they also resist the bending movement of the carpet-engaging section 13 rearwardly or upwardly relative to the base section 11 after it has been pounded down into place. This bending feature of section 13 also makes strip 10 particularly suitable for use in securing carpeting across doorways.

In connection with the embodiments illustrated in FIGS. 4 to 6, the dimpled or scalloped portions of the strip 30 and 30' considerably improve the structural rigidity of these strips, which as in the case of the first embodiment, could be manufactured from aluminum, steel, or synthetic material, as desired. This permits the strips to be made from substantially thinner gauge material than was heretofore possible, but without sacrificing any strength. In these embodiments, of course, the carpet-engaging section 33 is not intended to be pounded downwardly relative to the base section of the strip. Instead, the connecting rib section 32 always remains, in essence, at right angles to the spaced, parallel section 31 and 33 of the strip, so that in use, the teeth 34 of the strip 30 or 30' will remain in spaced, confronting relation to the wall W (FIG. 6) or other vertically disposed surface along with the edge of a carpet is to be secured.

One of the advantages of employing an adhesive layer on the upper surface of the carpet engaging sections 13 and 33 of the above-described strips is that, during the installation of certain types of carpeting, it is possible to utilize the layer 18 or 38 temporarily to hold the edge of the carpet during the cutting and stretching thereof. However, in those installations wherein power stretching is required to remove ripples, etc., from the carpeting, it is advisable first to secure the carpeting firmly beneath the carpet engaging section 13 or 33 before commencing the stretching operation.

While this invention has been described in connection with the use of adhesive layers 18, 21, 22, 38, 39 having pressure sensitive adhesive surfaces for engagement with carpeting, it will be apparent that other types of adhesive materials (other than pressure sensitive) can be used for the purpose, for example adhesive materials of the type disclosed in my U.S. Pat. No. 3,969,564.

While the invention has been illustrated and described in detail in connection with only certain embodiments thereof, it is to be understood that this application is intended to cover any further modifications of the invention as may fall within the scope of one skilled in the art or the appended claims.

Having thus described my invention, what I claim is:

1. An elongate carpet securing strip, having a plane base section adapted to be secured to a floor, a rib section integral with said base section and extending from one edge thereof in a plane inclined to said base section, a carpet-gripping section integral with, and inclined to, said rib section, and supported by said rib section in offset relation to said base section and any floor on which the latter is secured, said carpet-gripping section having a longitudinally extending edge over which the edge of a carpet is adapted to be folded, when the strip is in use, and combined mechanical and adhesive means on said carpet-gripping section engageable with a section of carpet to secure the latter in place, said means including a layer of material secured to the face of said carpet-gripping section and having an adhesive outer surface, and a plurality of spaced projections on said carpet-gripping section adapted to imbed in a section of carpet when the strip is in use, said carpet-gripping section being bendable about said rib section relative to said base section, and said plurality of spaced projections comprising the pointed ends of a plurality of carpet tacks, said tacks having the heads thereof positioned beneath said layer of material, and having the pointed ends thereof extending through openings in said carpet-gripping section to be forced downwardly through a carpet by bending said carpet-gripping section downwardly relative to said base section, when the latter has been secured to a floor.

2. An elongate strip as defined in claim 1, including two further layers of material secured, respectively, to the under side of said carpet-gripping section and said base section, and said further layers having adhesive outer surfaces disposed to engage, respectively, the back of a carpet and the floor on which the strip is to be secured.

3. An elongate carpet securing strip, having a plane base section adapted to be secured to a floor, a rib section integral with said base section and extending from one edge thereof in a plane inclined to said base section, a carpet-gripping section integral with, and inclined to, said rib section, and supported by said rib section in offset relation to said base section and any floor on which the latter is secured, said carpet-gripping section having a longitudinally extending edge over which the edge of a carpet is adapted to be folded, when the strip is in use, and combined mechanical and adhesive means on said carpet-gripping section engageable with a section of carpet to secure the latter in place, said means including a layer of material secured to the face of said carpet-gripping section and having an adhesive outer surface, and a plurality of spaced projections on said carpet-gripping section adapted to imbed in a section of carpet when the strip is in use, said base and carpet-gripping sections having formed therein a plurality of spaced indentations which extend transversely of the junctures of said base and carpet-gripping sections with said rib section, said spaced projections comprising a plurality of teeth formed along said longitudinally-extending edge of said carpet-gripping section, and a further layer of adhesive having its underside material secured to the bottom of said base section and having an exposed outer tacky surface disposed to engage the floor to which the strip is to be secured.

* * * * *